US012667763B1

(12) United States Patent
Ackerman

(10) Patent No.: US 12,667,763 B1
(45) Date of Patent: Jun. 30, 2026

(54) COLLAPSIBLE GOLF PUTTING GAME USING FOOTBALL POINTS FOR SCORING

(71) Applicant: Ira Philip Ackerman, Baltimore, MD (US)

(72) Inventor: Ira Philip Ackerman, Baltimore, MD (US)

( * ) Notice: Subject to any disclaimer, the term of this patent is extended or adjusted under 35 U.S.C. 154(b) by 774 days.

(21) Appl. No.: 18/079,208

(22) Filed: Dec. 12, 2022

(51) Int. Cl.
*A63B 67/02* (2006.01)
*A63B 71/06* (2006.01)

(52) U.S. Cl.
CPC ..... *A63B 67/02* (2013.01); *A63B 2071/0694* (2013.01); *A63B 2210/50* (2013.01)

(58) Field of Classification Search
CPC ..... A63B 67/02; A63B 2071/0694; A63B 2210/50
See application file for complete search history.

(56) References Cited

U.S. PATENT DOCUMENTS 5,042,813 A * 8/1991 Huang ..... A63B 67/02 473/197
5,108,101 A * 4/1992 Postula ..... A63B 67/02 473/158
2006/0040761 A1* 2/2006 Shin ..... A63B 67/02 473/278
2012/0010010 A1* 1/2012 Covino ..... A63B 67/02 473/174
2023/0226425 A1* 7/2023 Taylor ..... A63B 69/3676 473/278

FOREIGN PATENT DOCUMENTS

EP 1323454 A1 * 7/2003 ..... A63B 67/02
KR 20030035731 A * 5/2003
WO WO-2021187955 A1 * 9/2021 ..... A63B 71/06

OTHER PUBLICATIONS

Translation of KR 20030035731 A (Year: 2003).*

* cited by examiner

*Primary Examiner* — Jeffrey S Vanderveen
(74) *Attorney, Agent, or Firm* — Andrew S. Langsam

(57) ABSTRACT

A competitive skill game of alternating players putting a golf ball on a mat with the mat resembling a football field wherein the end of the mat is provided with a backboard having mouseholes for putting through whose openings or widths vary such that scoring is dependent upon the width of the mousehole, the wider the mousehole the fewer the points "won" by the putting player.

5 Claims, 4 Drawing Sheets

COLLAPSIBLE GOLF PUTTING GAME USING FOOTBALL POINTS FOR SCORING

BACKGROUND OF THE INVENTION

The present invention relates to a new and fun game to be played on a grass or artificial grass-like surface using the basics of putting in golf for the skill component and the points to be "won" consistent with obtaining the same in terms of ease or frequency of a football game. Preferably, the game can be easily carried in the trunk or back seat of a car or small truck and constructed/erected in a parking lot at a stadium or mancave or basement or even surface for instant fun and play. Even more preferably 2-4 (or more) players can enjoy this new game as a tailgate activity prior to a real football game to be observed (like a high school, college or professional football game for example). This new game involves a level of skill substantially similar to that of short putts on a golf green/miniature golf and, yet, the scoring of points (here the game is "won" by the higher point total of the player(s)) is consistent with the points, frequency and ease or difficulty of scoring in football i.e., three points for a field goal, six points for a touchdown, a single point for an extra point after a touch down, and two points for a slightly harder putt PAT after a touchdown. So, basically, the points capable of being "won" upon a successful putt from a distance through a hole in a backboard laid upon the ground, are 1, 2, 3, and 6 (as outlined above) with the difficulty of obtaining the points being somewhat related to the putting skill of the players. Other variations can be provided, e.g. the present game can have a 7 point successful putt corresponding to a very difficult Kick-Off return, a 4 point interception, a three point fumble, a 3 point sack of the quarterback, etc. But, basically, the present invention provides for one and two point after touchdown conversions, six points for a touchdown and the for a field goal (independent of distance although, that, too, can be accommodated with a short field goal being 3 points and a longer field goal either an extra putt or four points to the successful putter.

According to the preferred embodiment of the present invention, the game can be easily constructed of wood or plastic pieces (even possibly a metal like aluminum), along with an attached (but preferably detachable for washing) ground surface layer of grass-like carpet. Standing at one end of the "grass" is a short but wide back board about the width of the grass and made of simple wood or plastic like that of a 2"×4". Drilled through the backboard are spaced holes (like mouse holes in a floor board's floor molding consistent with a cartoon version of mouseholes). The holes extend down to the "grass" so that a ball can be putted on the grass and through the mousehole of the backboard. The holes will have varying widths to make a "harder" hole for putting a golf ball through it (and thus a higher point value) with the smallest width, and the easier hole having a wider width for lower competitive game point scoring. The players take turns trying to putt the ball from a few feet away (generally about 6 feet or so) from the holes in the backboard and if they have their golf ball pass through the hole on a single putt (variations can vary the rules by one, two or more shots, they "win" that number of points, 3, 6, 1 or 2. The number of shots hit by the putter to obtain the ball's passage through a hole can be factored into the scoring or ignored. Preferably a single putt either provides points or no points to the player. Players alternate and continue to play until a pre-determined minimum is achieved and a winner announced (or the play can terminate after a set number of putts (say 20) or even by time. Four putts per player consecutively as in four downs in football for a total of 16 putts per player per game seems highly suitable, too.

The present invention is similar to a corn hole toss game where two or more players participate and keep score until a certain limit is obtained in points. However it is quite distinct from cornhole in that the highest point total as in a football game after 4 quarters determines the winner. If the first player putts his/her golf ball into and through the "mouse" hole at the backboard, standing a predetermined few feet away, the player wins that many points corresponding to the difficulty of the putt which is dependent upon the width of the hole. So, for example, a wider mouse hole for putting the ball through is worth fewer points than a hole having a smaller width. Players take turns originating their putts say from the same distance or varying the distance, say, 4 feet, five feet and six feet and completing either to a maximum number of shots per turn or until their ball passes through the hole. Varying distance can be used if the player's ball goes off of the playing surface-like in real football there is a penalty on a kickoff if the ball goes out of bounds. The players can be required to first pass through the smaller hole (for a touchdown and 6 points) before attempting a second set of putt(s) through the PAT (points after touchdown-one or two points then available). If the player desires to go for a field goal (3 points) they will try to putt through the hole with a medium width opening.

The game is very lightweight, easy to collapse and carry/store in a trunk of a vehicle and similarly easy to place on asphalt, dirt or on grass near to or in the stadium parking lots (for tailgating fun). The backboard with the varying size/width holes (to allow the putted passthrough of the golf balls, pushed toward the holes by an ordinary golf putter) can have a rear ball capturing area, i.e., behind the backboard, surrounded by additional pieces of 2"×4" wood or plastic members which can be hinged or held in brackets for ease of take down and assembly, but for ensuring that the balls putted through the holes do not get lost, but, rather, get captured in the holding area (behind the backboard). Similarly, the sides of the backboard can be provided with forwardly extending wood or plastic members (also 2"×4" pieces of wood) to ensure that a ball putted so as not to even hit the backboard will also be contained. The side pieces can extend forwardly from the backboard and provide a neat edge to the "grass" or contained area in front of the backboard. Preferably, the grass is provided with markings so that it resembles a football field, with end zones, side lines, yardage markings, hash lines, etc. This gives the putting game the overall "feel" of a football game, consistent with the points capable of being obtained by skill in putting the ball (an ordinary golf ball) through the various sized in width holes in the backboard.

The present invention is meant to be fun, easy to play, combines the skill of putting golf with the score keeping of a football game, is easy to assemble for quick play and easy to disassemble after use (for then walking into the stadium). Many variations can be provided but the basics are maintained, putting a golf ball as the skill, preferably keeping score consistent with a football game, easy to assemble and disassemble, preferably being played on a football looking field of grass or artificial rug material marked as a football field.

DESCRIPTION OF THE PRIOR ART

Many lawn games are played combining skill and keeping score. There is horseshoes, mini-golf, skee-ball, bocce ball, corn hole toss, throwing a football through a hole in a target, etc. These all combine a skill and keeping score. To Applicant's current knowledge, there is, however, no skill based, portable lawn game combining the skill of putting short distances, without distractions of mini golf (mechanical windmills, loop de loops, multiple levels, etc.) but with putting skill on a grass-like surface through a set of simple mouseholes at a short distance of differing widths where the size/width of the holes determines the number of points won by a player and where the points are coordinated to football-like scoring. This is a basic novelty of the present invention.

In addition, the present invention is lightweight, quick to set up and knock-down, able to be assembled in a parking lot and retains the ball from running free to otherwise be quickly lost beneath a nearby car in a parking lot. The invention is preferably made of 2"×4" pieces of wood, connected together with single brackets or hinges and can be carried in the trunk of a car and quickly/easily assembled to play. Preferably, the present invention is a tail gate party amusement/distraction prior to a football game/man cave or basement or club room, in the parking lot adjacent the stadium, which generally has large amounts of flat, asphalt or dirt to play upon. In one and the preferred embodiment of the present invention, the base of the game, in front of the holes in the backboard, is a fake grass surface like a green of a golf course or "astroturf" carpet to provide a smooth, lightweight, and realistic golf putting surface.

SUMMARY OF THE INVENTION

A game is provided which is based on the skill of golf putting and the scoring of football. The game is "set up" by putting a short backboard on the ground, preferably level and more preferably a stretch of asphalt in a parking lot adjacent a football stadium to pass the time of tailgating and having fun while doing so. The backboard is provided with several holes visually similar to cartoonish mouse holes extending upward from the bottom of the backboard and in contract with the parking lot. A ball can pass through these holes. The tops of the holes are curved so that the entire backboard resembles a series of adjacent mouseholes. In this manner the holes are similar in look to cartoon-like mouseholes through the floor side moldings. The mouseholes are of differing widths so that putting a golf ball through a narrow-relative width of hole is more difficult, from even a short distance, than putting a golf ball through a relatively more wide hole, from the same distance. The path from the participant to the holes can be a few feet, say 6 feet, or can be more, say 10-15 feet. In the preferred embodiment of the game provided hereby, a straight putt is meant to have the ball pass through the hole and an errant putt will not pass through any hole as it will come into contract with the backboard. In an alternate embodiment, a small cone or other device can be simply placed on the putting surface and the player may be forced to go around the cone or device in one or two putts for then finishing the hole by "holing out" by having the golf ball pass through the desired mousehole.

The putting surface of the game can most preferably have visible markings on the grass like preferably a football field. This artificial surface is small (about 4-5 feet in width and about 7 feet in length and can cover the asphalt and provide a smooth putting surface, more akin to a golf putting green. Multiple starting locations can be marked on the surface (at 3, 4, 5 and 6 feet from the holes. The game can dictate the location of the start putt or the player can select the same, depending upon the number of points needed/wanted by the player during the game. Clearly, the longer the putt, or the more angled the putt to the hole(s) the more points to be scored when the ball passes through the hole. Players take turns putting their ball from start to and through the hole(s) and keep score. In the preferred embodiment, the player plays all of his/her balls from about 6 feet and decides which of the holes to aim for. The field for putting is preferably marked with a football field's markings, including sidelines, end zones, yard markings, hash lines, numbering of the 10 yard increments, etc. and can even be provided with a name or distinctive Logo at the center and/or in the endzones. This adds to the play value of the game as a distraction prior to the football game itself.

The physical game is preferably made from wood, light metal or plastic pieces as the backboard. A carpet or grass-like surface is provided, preferably in the shape and general relative dimensions of a tiny football field. The yard markers are provided and hash lines as well as out of bounds, touchdown or end zone areas, etc. The artificial grass or carpet resembles a football field and the center and endzones can be decorated with a team(s) logos and names or the owner's name. The carpet area is the area upon which the players will locate their ball(s) and start to play with each player, preferably, putting or striking the ball until they "hole out" i.e., until they have their ball, stroke by stroke, pass through an opening in the backboard, at one end of the carpeted field (or the game can be played as one stroke and the ball either scores the player points or not)—a single stroke per attempt. Strokes are counted (or not) and if the ball passes through a hole, they earn that number of points but if the ball hits the backboard and doesn't pass through the mousehole, their play is finished. They will get points based on which of the holes their ball passes through and/or which stroke (the first, second or third) causes the ball to pass through the hole (in the game where multiple stroke are allowed). For example, a player having his ball pass through a field goal indicated hole on his first stroke may obtain 3 points but if the ball is hit or putted three times and then through the field goal-wide mousehole in the backboard, the player's score would be 3 points for the field goal. Or, the scoring can be player by player getting a single shot at the backboard and scoring zero or the number of points for the mousehole through which the ball passes on that single putt. Variations in scoring, of course, can be provided.

Preferably located behind the mouseholes and the backboard are capturing areas which stop the balls after they pass through the mouseholes and prevent the balls from becoming lost or going astray. The size and/or widths of the mouseholes for putting through vary and are widest for the lowest points awarded to the player and narrowest for the most points obtainable, e.g., six points for a touchdown. In an alternate embodiment, extra mouseholes can be, provided through the backboard which correspond to an interception or fumble or on-side kick, giving the player a loss of turn, different points, an extra turn, etc.

After play is completed, say 10 turns at putting for 2-4 players, the game can be easily disassembled and the carpet wrapped or rolled up for storage. The backboard and the retention areas can be easily collapsed or disassembled. In an alternate embodiment, the sides of the carpet/field can also be lined with wood or plastic pieces (same height and depth as the backboard) to ensure the putted balls stay on the carpet and don't get lost due to a mishit shank, slice, etc.

DETAILED DESCRIPTION OF THE PREFERRED EMBODIMENT AND THE DRAWINGS

Figure 1:
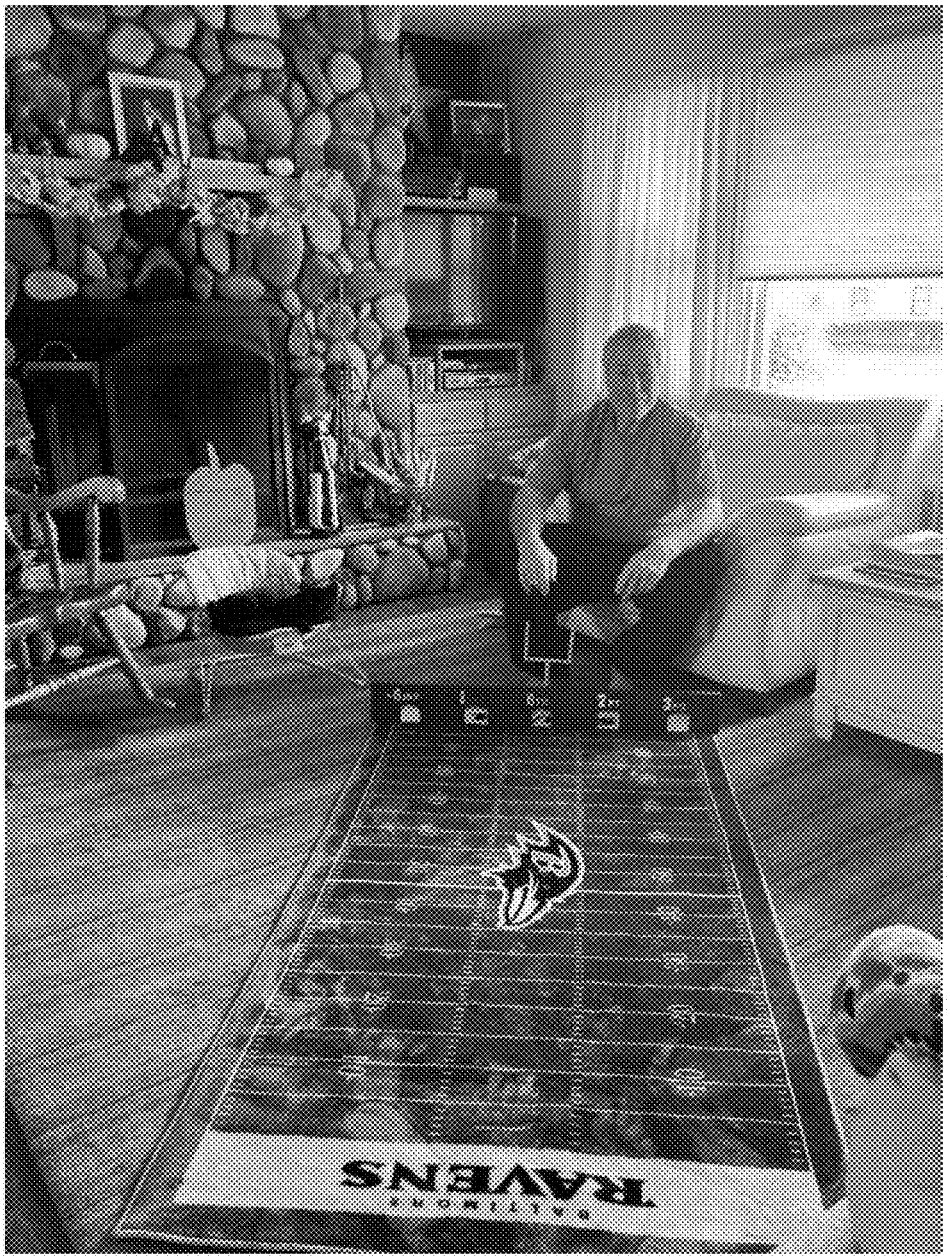
FIG. 1 is a top, front and perspective view of the preferred artificial grass or putting green for the game as set forth on a flat surface and bearing markings consistent with a football field, with the backboard (and mouseholes) in the distance.

The game is a simple golf putting game, intended to be played at a tailgate party but can, of course, be placed and played elsewhere. Preferably the surface is rolled out and placed on a flat, somewhat smooth and level surface, most suitably, asphalt or dirt forming a small section of a parking lot or area near to a stadium (but can, of course, be played on a floor in a basement, room, or even in a hallway). At a stadium parking lot, tailgating can take place and the fun of having a skill-based game for passing time in a competitive manner (which in some manner relates to a football game soon to be played) can be easily presented for enjoyment. As can be seen, the flat grass-like putting surface is only about ¼ inch in thickness and about 5 feet wide and about 6-8 feet in length. The mat or grass is thin and can be rolled out easily and the entire mat surface has minimum weight. Preferably, for maximizing enjoyment, the mat 20 is printed with the markings of a standard high school/college/professional football field markings. As can be seen, the side lines 22 and 24 are inwardly recessed from the edges 21 and 23 of the mat 20, as are the far back lines 26 and 28 demarking the far ends of the two opposed endzones 30 and 32. Then, extending from the endzones towards one another are marked increments of the mat, with markings for the equivalents of the goal line, and then 10 yards, from the goal lines 40 and 42 toward one another, progressing as 10, 20, 30, 40 and 50, and then 40, 30, 20, and 10 to the opposing goal line. The sidelines 22 and 24 are provided with the traditional 2, 4, 6 and 8 yard markings between the ten yard markings, on both sides and central 2 yard hash lines 50 and 52 also provided. In visual effect, the mat 20 looks like a down-sized realistic football field. Even the locations 54, 56, 58 and 60 for the uprights of the goal posts (not shown in FIG. 1) can be marked. Also, note that the 2 yard marks 62 and 64 are located near the goal lines and between the central hash lines 50 and 52.

In a preferred embodiment of the invention, the central area can be printed with a large Logo (here the Baltimore Ravens Logo 70 of the National Football League is provided and the two end zones can be similarly marked or printed with RAVENS in one end zone and BALTIMORE in the other. Other Logos and names can be printed, of course. Or, the vendor can provide a service whereby the endzones and/or the center of the field or mat 20 is provided with a personally selected name or Logo. The preferred background color of the mat is green to resemble a football field and the yard, endzones, sidelines, hash lines, etc. printed in distinctive white. This is the putting surface. It can be easily rolled out on the ground or rolled into a cylinder, like a yoga mat, when storage is desired.

Snapped or otherwise attached to the smaller of one of the ends 68 of the mat 20 or simply placed thereon is a backboard 75. It is preferably made of smooth wood, lightweight metal or plastic. The backboard will extend between or slightly beyond the outer edges of the mat and will be about 4 inches in height above the dirt or asphalt whether sitting on that or on the mat 20. The backboard is about 1-2 inches in thickness and when placed on the asphalt or dirt of the parking lot will preferably "stand" on its own. If necessary, rearward extending pieces like legs or L-shaped brackets (not shown) can be provided to facilitate and maintain the backboard 75 to remain standing even if a gust of wind hits it or a ball is putted into it. The backboard is meant to be self-standing. As can be seen, in the preferred embodiment, a set of mouseholes 80, 82, 84, 86, and 88 are provided from and through the face of the backboard and exiting the rear surface 92 thereof. These mouseholes are cut into and through the backboard and have curved upper walls 94, 96, 98, 100 and 102 like arches and vertical and parallel side walls for each mousehole, e.g. 104 and 106. There is no bottom edge to each mousehole as the base of the backboard with the cut outs of the mouseholes sits directly on the dirt or asphalt or upon the mat. In this way, a golf ball putted directly to the mousehole will easily pass therethrough and not be stopped on its way through by any bottom edge to the backboard.

As can be appreciated, the mouseholes 80, 82, 84, 86 and 88 are of varying width, i.e. spacing between the vertical side walls 104, 106 so that some mouseholes are easier to putt a golf ball through (wider mouseholes) than the narrower width mouseholes. According to the preferred embodiment, the narrowest mousehole is "worth" six points. The points after a touchdown (after the 6 points) can be either a single point or two points with the single point for a PAT being easier (wider) to putt through than the two point PAT conversion. In one embodiment of the game, as shown, a small width hole can be worth a minus 6 points (to the other Player) as a "pick-six" interception by the putting Player.

Figure 2:
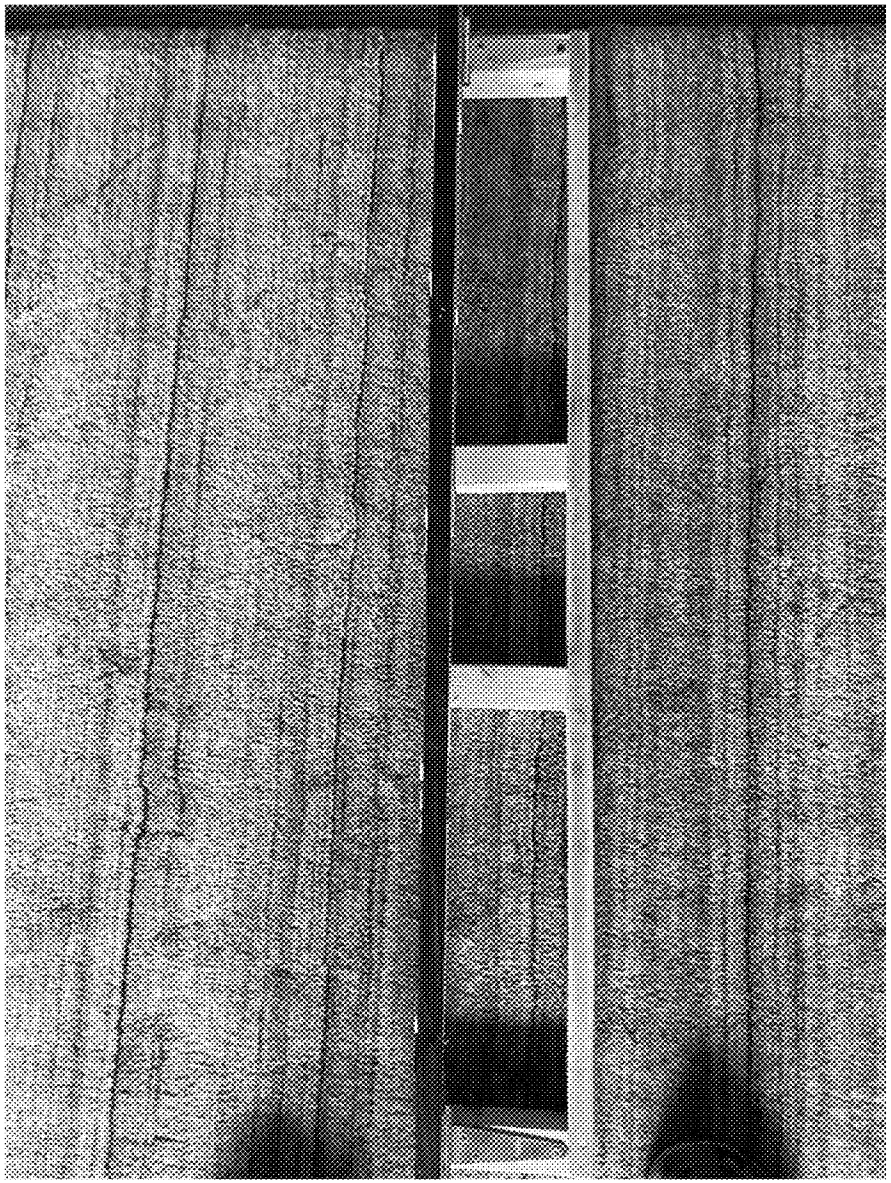
FIG. 2 is a top plan view of the backboard and small holding or capturing areas for the balls of the present game.

As seen in FIG. 2, without the mat 20 attached, located behind the backboard location is one or more ball-holding areas 104, formed of wood, lightweight metal, or plastic components similar to the backboard. There are, however, no mouseholes in these pieces. One larger or longer solid piece 102 is located behind and parallel to the backboard but a few inches behind it, while a few rearward extending struts can be located for support and integrity between the rear of the backboard 75 and the front of the longer piece 102. The ball-holding areas 104 can be dispensed with but are considered helpful to ensuring that the balls will not go astray after being putted through the mouseholes. The ball-holding areas can be held to the backboard by brackets, screws, nails, hinges, bolts and nuts, etc.

Figure 3:
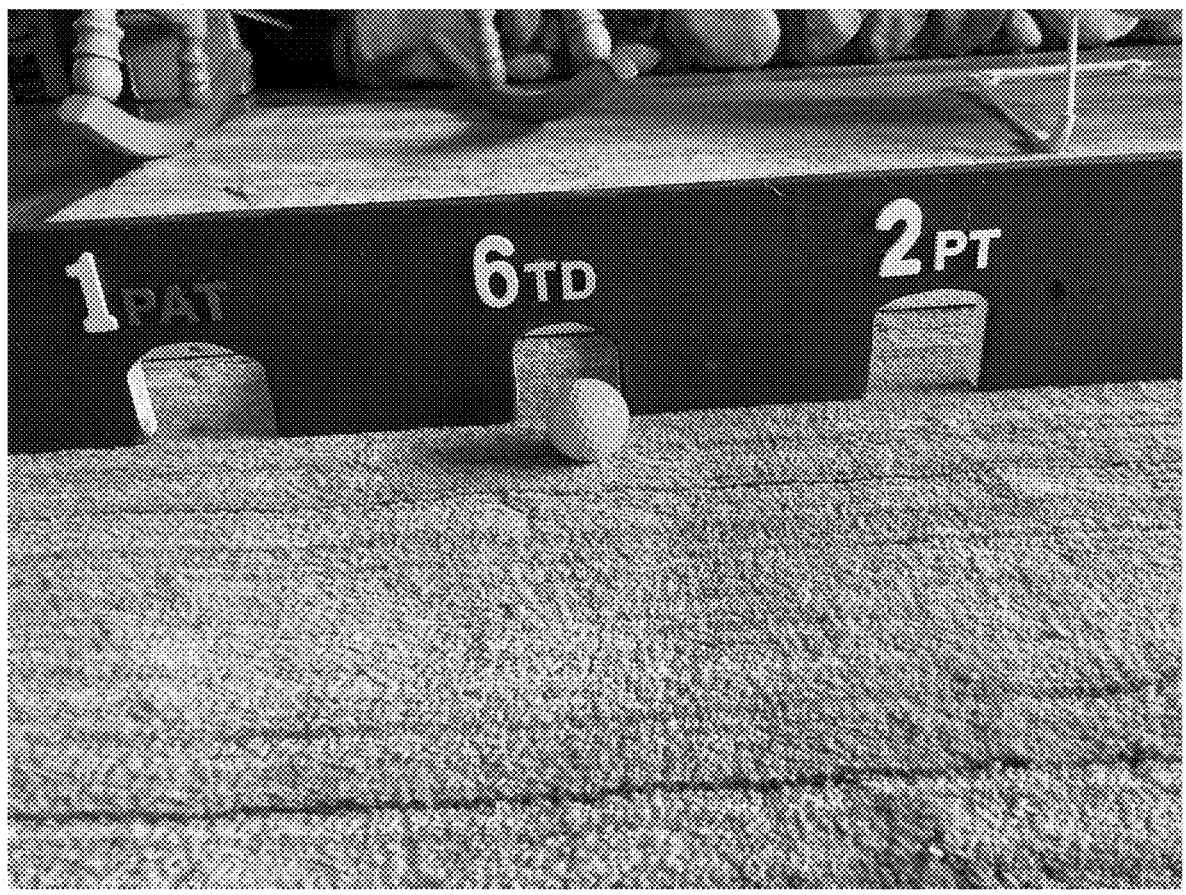
FIG. 3 is a partial, front, top and enlarged view of the backboard (left side only) with a ball adjacent one of the mouseholes.

FIG. 3 shows the relative preferred widths of the single and two points after (PAT) touchdown of the mouseholes and that of the 6 points for a touchdown. These can be sized according to the age/skill level of the Players. A golf ball 100 is shown, too, for size in relation to the widths of the mouseholes. Here, too, the backboard is shown separate from the playing mat or surface for ease of illustration and understanding of the invention.

Figure 4:
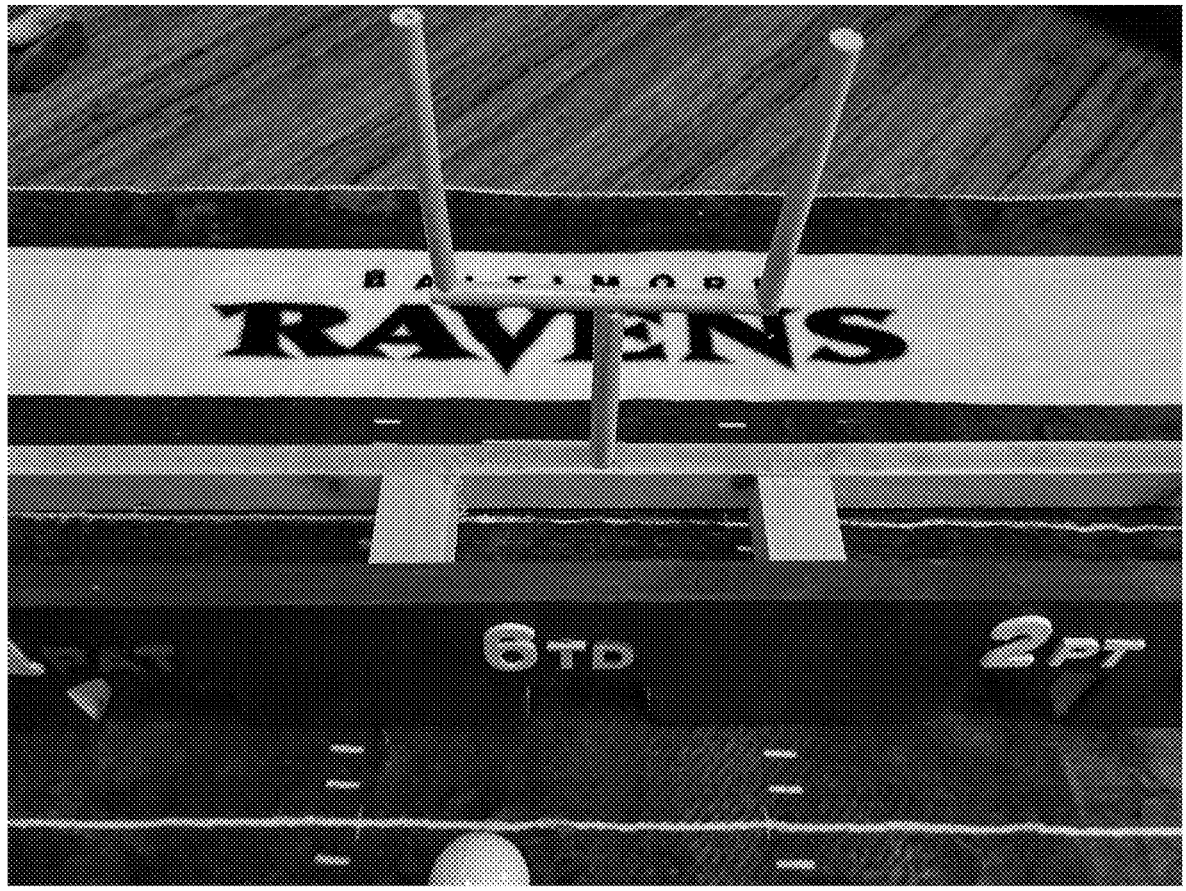
FIG. 4 is an enlarged, partial top and front perspective view of the front and the ball-holding areas behind the backboard showing a realistic upwardly extending goalpost placeable beyond the golf putting playing surface but with the ball holding area on the rear of the rollable rug or playing area.

FIG. 4 shows a set of goalposts 104 which are preferably formed of simple small diameter wood dowel rods and then, upon assembly, placed into a central hole 106 in the rear solid and longer piece 102, to simulate the goal posts of a real football field. When disassembly is desired, the goalposts 104 is simply pulled out of the hole 106.

The number of points and justification for the relative points for the golf ball 100 passing through the different width mouseholes is preferably shown on the front of the backboard. Here, the points offered for a successful putt of the golf ball are −6 (points taken from the opponent indicative of an interception returned for a touchdown); one point for a PAT but only after first obtaining a TD on the prior putt; 6 points for a TD (touchdown), followed by an attempt at either the 1 or 2 PAT mousehole; 2 points for a PAT putt which is a mousehole slightly less wide than the 1 point PAT mousehole and, again, only after a touchdown or 6 point putt is obtained, and 3 points for a field goal, with that mousehole being less wide than that of the touchdown (6 points) and yet preferably greater in width (easier to hole) than the −6 points for a pick-six interception resulting in a touchdown.

The backboard and mat can be easily rolled or folded up when the game is finished and redeployed when desired. The entire game is lightweight, easy to assemble and just as easy to disassemble.

In playing, two or more (although a single person can have fun just practicing putting and playing) participants take turns putting from a predetermined distance, say, 5 feet by placing their ball on the 10 or 20 yard line and selecting the mousehole to try to putt through. If on a single putt, the ball goes through the mousehole, the player gets that many points. If it goes through the touchdown or 6 point (most difficult) mousehole then the player gets a shorter second putt from say the 50 yard line, in front of the 1 or 2 point conversion (wider) mousehole. A preset number of turns for each participant can be taken and the player with the most points at the end will be declared the winner.

In an embodiment of the game, a coin toss can determine who putts first with the winner of the coin toss deciding to go first or defer to go first (as in real football games) at the start of the second half. Each player gets 4 putts starting at the proximal goal or other yard line per quarter as in four downs per possession in football. Rather than alternating putters, each player can take 4 individual putts on the four initially-placed balls. This simulates offensive possessions (four downs) like real football. Each player gets 4 putts per quarter. In the embodiment having the pick six option, the size of the mousehole is the same as the touchdown but, here, if a player knocks it through the pick six mousehole, six points is subtracted from his opponent's score. One player can only seek a single or two point conversion after either a touchdown or the pick six mousehole. If a player hits a ball off the playing surface, the opponent starts his putting on the next forward ten yard line of the playing surface. If the player hits 2 balls off of the playing surface, the opponent starts from a place forward of the original starting yard line by 20 yards. In the event of a tie, each player will putt 4 balls and the highest total for the "overtime" determines the winner. If tied after the first 4 balls of overtime, another overtime can happen with 4 balls per player.

What I claim is:

1. A game surface comprising a flexible mat having two configurations, namely collapsed and ready for use, said ready for use configuration being a mat for laying upon a ground surface, said ready for use configuration having a larger dimension than when said mat is collapsed, the texture of said surface allowing for putting a golf ball thereon, said mat with at least one far end a tee area and sides, said mat having markings thereon resembling a conventional football field with said markings reflective of sidelines, yard markers, goal lines and end zones and optionally including goal posts, and at said far end of said mat, a backboard extending vertically upwardly and above the mat when in said ready for use configuration and provided with at least two holes passing therethrough with said holes having different widths, and each of said widths being at least wide enough to allow for passage of a golf ball.

2. A surface for a game as claimed in claim 1 wherein said mat can roll up for storage into said collapsed configuration.

3. A surface for a game as claimed in claim 1 wherein said backboard is about the size of a 2"×4" piece of wood with a length extending substantially along said short end.

4. A surface for a game as claimed in claim 1 wherein 5 mouseholes are provided with at least two different widths.

5. A surface for a game as claimed in claim 1 wherein said backboard is provided with a rear-located golf ball capturing and -retention area bounded by additional elements which also extend substantially vertically upwardly and above the surface of said ready for use mat.

* * * * *